US007355109B2

(12) United States Patent
Muramatsu et al.

(10) Patent No.: US 7,355,109 B2
(45) Date of Patent: Apr. 8, 2008

(54) SEPARATE AUTOMATIC PLAYER DRIVING KEYS AND PEDALS OF KEYBOARD MUSICAL INSTRUMENT

(75) Inventors: Shigeru Muramatsu, Shizuoka-ken (JP); Katsuo Ito, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 557 days.

(21) Appl. No.: 11/091,866

(22) Filed: Mar. 28, 2005

(65) Prior Publication Data

US 2005/0235801 A1 Oct. 27, 2005

(30) Foreign Application Priority Data

Apr. 21, 2004 (JP) ..... 2004-124965

(51) Int. Cl.

| | |
|---|---|
| ***G10F 1/02*** | (2006.01) |
| ***G10F 3/00*** | (2006.01) |
| ***G10C 3/26*** | (2006.01) |
| ***G10H 1/18*** | (2006.01) |
| ***G10H 7/00*** | (2006.01) |

(52) U.S. Cl. ..... 84/13; 84/20; 84/107; 84/225; 84/615

(58) Field of Classification Search ..... 84/13, 84/20, 225, 107, 615

See application file for complete search history.

(56) References Cited

U.S. PATENT DOCUMENTS

| | | | | | |
|---|---|---|---|---|---|
| 4,018,128 | A | * | 4/1977 | Megee | 84/231 |
| 4,206,677 | A | * | 6/1980 | Ramsey | 84/107 |
| 4,513,652 | A | * | 4/1985 | Muramatsu et al. | 84/20 |
| 4,843,936 | A | * | 7/1989 | Murakami et al. | 84/107 |
| 4,873,905 | A | * | 10/1989 | Murakami et al. | 84/20 |
| 4,913,026 | A | * | 4/1990 | Kaneko et al. | 84/21 |
| 5,210,367 | A | * | 5/1993 | Taguchi et al. | 84/746 |
| 5,247,129 | A | * | 9/1993 | Nozaki et al. | 84/615 |
| 5,506,369 | A | * | 4/1996 | Kawamura et al. | 84/20 |
| 5,515,759 | A | * | 5/1996 | Geoghegan | 84/225 |
| 5,565,635 | A | * | 10/1996 | Kaneko et al. | 84/20 |
| 5,594,188 | A | * | 1/1997 | Kawamura et al. | 84/171 |
| 5,602,351 | A | * | 2/1997 | Kawamura et al. | 84/171 |
| 5,861,566 | A | * | 1/1999 | Kaneko et al. | 84/13 |
| 5,880,389 | A | * | 3/1999 | Muramatsu | 84/615 |
| 5,905,220 | A | * | 5/1999 | Lee et al. | 84/461 |

(Continued)

FOREIGN PATENT DOCUMENTS

| | | |
|---|---|---|
| JP | 64-4497 | 1/1989 |

*Primary Examiner*—Lincoln Donovan
*Assistant Examiner*—Christina Russell
(74) *Attorney, Agent, or Firm*—Harness, Dickey & Pierce, PLC

(57) ABSTRACT

A separate automatic player is independent of a piano, and stands in front of the piano for an automatic playing; the separate automatic player includes a key driver unit, a pedal driver unit and a framework on which the key driver unit and pedal driver unit is carried; the key driver unit has an array of key actuators so as to selectively depress and releases the black and white keys, and a pair of side elevators and a rotary unit is provided between the framework and the array of key actuators; the side elevators bring the plunger heads of the key actuators into contact with the upper surfaces of the black and white keys, and the rotary unit makes the plungers vertical to the upper surfaces so that the key actuators exert force on the black and white keys at the magnitude exactly equivalent to pieces of music data.

20 Claims, 8 Drawing Sheets

U.S. PATENT DOCUMENTS 5,922,983 A * 7/1999 Muramatsu ..... 84/626
6,359,207 B1 * 3/2002 Oba et al. ..... 84/658
6,362,405 B2 * 3/2002 Koseki et al. ..... 84/2
6,380,469 B2 * 4/2002 Uehara ..... 84/439
6,969,791 B2 * 11/2005 Fujiwara ..... 84/13
7,238,868 B2 * 7/2007 Muramatsu et al. ..... 84/20
7,238,873 B2 * 7/2007 Fujiwara et al. ..... 84/600
7,265,281 B2 * 9/2007 Sasaki et al. ..... 84/13
7,268,289 B2 * 9/2007 Muramatsu et al. ..... 84/719
7,279,630 B2 * 10/2007 Sasaki et al. ..... 84/723
2001/0000569 A1 * 5/2001 Meisel ..... 84/688
2001/0007219 A1 * 7/2001 Uehara et al. ..... 84/609
2001/0007221 A1 * 7/2001 Uehara ..... 84/649
2001/0054346 A1 * 12/2001 Uehara ..... 84/21
2005/0150361 A1 * 7/2005 Muramatsu et al. ..... 84/626
2005/0211048 A1 * 9/2005 Fujiwara ..... 84/13
2005/0211049 A1 * 9/2005 Fujiwara et al. ..... 84/13

* cited by examiner

SEPARATE AUTOMATIC PLAYER DRIVING KEYS AND PEDALS OF KEYBOARD MUSICAL INSTRUMENT

FIELD OF THE INVENTION

This invention relates to an automatic player and, more particularly, to an automatic player for performing a piece of music on a keyboard musical instrument.

DESCRIPTION OF THE RELATED ART

An automatic player piano is an example of a hybrid keyboard musical instrument. The automatic player piano is broken down into an acoustic piano and a built-in automatic player, and the built-in automatic player is installed in the acoustic piano before delivery to users. In other words, the manufacturer completes the automatic player piano, and sells it in the market. However, there are a lot of acoustic pianos at homes. The owners may wish to enjoy the automatic playing on their acoustic pianos.

Separate automatic players have been proposed to those owners. The owners, who wish to enjoy the automatic playing on their acoustic pianos, purchase the separate automatic players, and install them on their acoustic piano. When the owners instruct the separate automatic players to perform a piece of music, the automatic player fingers the piece of music on the keyboard so that the owners enjoy the automatic playing.

A typical example of the separate automatic player is disclosed in Japan Utility Model Application laid-open Sho 64-4497. The prior art separate automatic player includes a cabinet with legs, an array of key actuators downwardly projecting from the housing and a controller for selectively actuating the key actuators. The legs are placed on the key blocks, which are exposed to the outside on both sides of the keyboard, and the legs keep the housing extending over the keys. The housing is equipped with a height adjuster, and the user adjusts the key actuators to relative positions with respect to the keys by manipulating the height adjuster. The controller makes the driving circuit sequentially supply driving signals to the key actuators, and the plungers downwardly project and are retracted so as to depress and release the keys.

However, the prior art separate automatic player is available only for a certain model. In other words, the prior art separate automatic player is customized to the certain model of acoustic piano. This is because of the fact that acoustic pianos have individual dimensions. For example, grand pianos are different in dimensions from upright pianos and small-sized grand pianos. The distance between the key blocks is different between the certain model of acoustic piano and other models of acoustic piano, and the keyboards are differently inclined.

Another problem inherent in the prior art automatic player is that the piece of music is imperfectly reenacted. The reason for the imperfection is that the prior art automatic player does not have any pedal actuator. Even though a pianist selectively steps on the pedals in the original performance, the prior art automatic player can not move the pedals in the automatic playing so that the listeners feel the piece of music plane.

The present inventors searched a database for another prior art, and found U.S. Pat. No. 4,206,677. In the U.S. patent, Ramsey discloses a pedal actuator for an electronic player piano. The prior art pedal actuator is combined with an upper unit, in which the key solenoids are incorporated for playing the keys. The prior art pedal actuator selectively steps on the pedals of the acoustic piano during the playback on the basis of pieces of music data so as to give the effects to the acoustic piano tones. Howeve the listeners feel the automatic playing slightly different from the original performance.

SUMMARY OF THE INVENTION

It is therefore an important object of the present invention to provide an automatic player, which can faithfully play a music passage on various models of acoustic pianos.

The present inventors contemplated the problem, and noticed that the key actuators had inclined on the keys. In this situation, even if the key actuators were driven on the basis of a common piece of music data, those key actuators exerted the force on the keys at magnitude equivalent to that expressed by the common piece of music data, and only a component force gave rise to the key motion. This was the reason why the listeners felt the automatic playing different from the original performance.

To accomplish the object, the present invention proposes uniformly to adjust actuators to a proper relative position with respect to associated keys.

In accordance with one aspect of the present invention, there is provided a separate automatic player independent of a keyboard musical instrument, which has a fore-and-aft direction, a lateral direction crossing the fore-and-aft direction at right angle and an up-and-down direction normal to a plane defined by the fore-and-aft direction and the lateral direction, and the separate automatic player comprises a key driver unit including a key actuator unit having an array of key actuators selectively driving keys of the keyboard musical instrument for producing tones, a first regulator connected to the key actuator unit and moving the key actuator unit in the up-and-down direction so as to make the array of the keys in parallel to the upper surfaces of the keys and a second regulator connected to the key actuator unit and rotating the key actuator unit about a lateral line extending in parallel to the lateral direction so as to vary an angle between centerlines of the key actuators and a virtual plane defined by the lateral line and a vertical line normal to a floor where the keyboard musical instrument stands and a pedal driver unit selectively stepping on pedals of the keyboard musical instrument.

BRIEF DESCRIPTION OF THE DRAWINGS

The features and advantages of the separate automatic player will be more clearly understood from the following description taken in conjunction with the accompanying drawings, in which.

DESCRIPTION OF THE PREFERRED EMBODIMENT

In the following description, term "front" is indicative of a position closer to a player, who is sitting on a stool for playing a music passage on a keyboard musical instrument, than a position modified with term "rear". A line, which is drawn between a front position and a corresponding rear position, extends in a "fore-and-aft" direction, and the fore-and-aft direction crosses a "lateral direction" at right angle. An "up-and-down" direction is normal to a plane defined by the fore-and-aft direction and lateral direction.

Separate Automatic Player Ready for Automatic Playing

Figure 1:
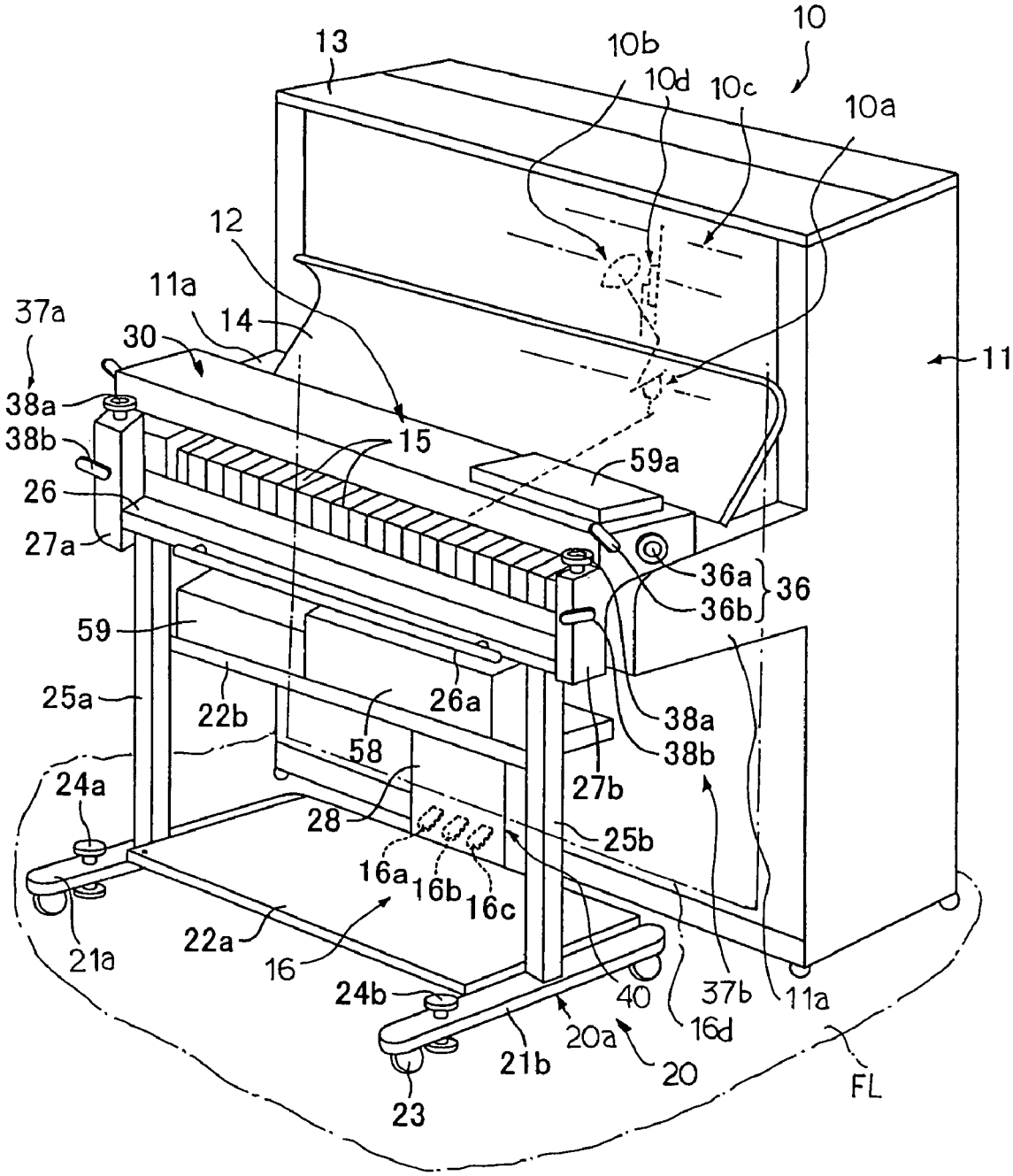
FIG. 1 is a perspective view showing a separate automatic player of the present invention which gets ready to perform a music passage on an upright piano.

Referring to FIG. 1 of the drawings, an upright piano 10 is shown together with a separate automatic player 20 embodying the present invention. The upright piano 10 is installed on a floor FL, and the separate automatic player 20 is movable on the floor FL. Moreover, the separate automatic player 20 is compact and light enough for users to move it to another floor. Thus, the separate automatic player 20 is sharable with other acoustic pianos.

The separate automatic player 20 reenacts a performance, which is expressed by a set of music data codes. When a user wishes to enjoy the automatic playing, he or she moves the separate automatic player to the upright piano 10, and adjusts separate automatic player to a proper position in front of the upright piano 10. The user specifies the set of music data codes, and instructs the separate automatic player 20 sequentially to process the pieces of music data expressed by the set of music data codes. The separate automatic player 20 starts the data processing, and continues the data processing until the last piece of music data. The pieces of music data indicate the pitch of acoustic piano tones to be produced, loudness, timing to produce the acoustic piano tones, timing to decay the acoustic piano tones and effects to be imparted to the acoustic piano tones. The separate automatic player 20 is responsive to the pieces of music data, and plays the music passage on the acoustic piano 10.

Acoustic Piano

The acoustic piano 10 includes a piano cabinet 11, a keyboard 12, an array of action units 10*a*, an array of hammers 10*b*, strings 10*c* and an array of dampers 10*d*. The keyboard 12 is mounted on a front portion of the piano cabinet 11, and the array of action units 10*a*, array of hammers 10*b* and strings 10*c* are installed inside the piano cabinet 11. The array of action units 10*a* is linked with the keyboard 12, and the array of hammers 10*b* is further linked with the array of action units 10*a*. The strings 10*c* are vertically and obliquely stretched, and are opposed to the array of hammers 10*b*. The array of dampers 10*d* is linked with the keyboard 12, and the dampers 10*d* are spaced from and brought into contact with the strings 10*c* depending upon the current key positions.

While a pianist is fingering on the keyboard 12, the action units 10*a* are selectively actuated, and the associated hammers 10*b* are driven for free rotation toward the strings 10*c* by the actuated action units 10*a*. The dampers 10*d* are spaced from the strings 10*c* before the hammers 10*b* reach the strings 10*c*, and, thereafter, the strings 10*c* are selectively struck with the hammers 10*b* at the end of the free rotation. Then, the strings 10*c* vibrate, and a sound board (not show) resonates with the strings 10*c* so as to produce the acoustic piano tones. After the release, the dampers 10*d* are brought into contact with the strings 10*c*, again, and the vibrations are decayed. Thus, the component parts 12, 10*a*, 10*b*, 10*c* and 10*d* behave as similar to those of a standard upright piano.

The piano cabinet 11 has a generally rectangular parallelepiped configuration, and a pair of arms 11*a* forwardly projects. The keyboard 12 is located on a key bed (not shown) which forms a part of the piano cabinet 11, and is located between key blocks (not shown) abutted to the arms 11*a*. A fall board 14 is rotatably supported by the arms 11*a*, and the keyboard 12 is exposed to and hidden from users by means of the fall board 14. Top boards define the upper boundary of the piano cabinet 11, and the front top board 13 is opened and closed.

The keyboard 12 includes black keys (not shown) and white keys 15, and the black keys (not shown) and white keys 15 are laid on the well-known pattern between the key blocks.(not shown). The black keys (not shown) and white keys 15 are respectively linked with the action units 10*a*, and the force, which is exerted on the front portions of the keys 15, is transmitted to the associated action units 10*a*. Thus, the black keys (not shown) and white keys 15 give rise to the series of actions described hereinbefore.

The upright piano 10 further includes a pedal mechanism 16. A soft pedal 16*a*, a muffler pedal 16*b* and a damper pedal 16*c* form the pedal mechanism 16 together with link works 16*d*, and the three pedals 16*a*, 16*b* and 16*c* forwardly projects front the lower portion of the piano cabinet 11. When a pianist steps on the soft pedal 16*a*, the acoustic piano tones are reduced in loudness. The muffler pedal 16*b* or a sostenuto pedal makes an acoustic piano tone reduced in loudness. When the pianist wishes to prolong the acoustic piano tones, he or she steps on the damper pedal 16*c*. While the pianist is performing a piece of music on the upright piano 10, he or she gives artificial expressions to the acoustic piano tones through the pedal system 16.

Separate Automatic Player

The separate automatic player 20 includes a framework 20*a*, a key drive unit 30 and a pedal drive unit 40. The framework 20*a* is movable on the floor FL, and retains the key drive unit 30 over the keyboard 12 and the pedal drive unit 40 over the soft, muffler and damper pedals 16*a*/16*b*/16*c*.

Framework

Figure 2:
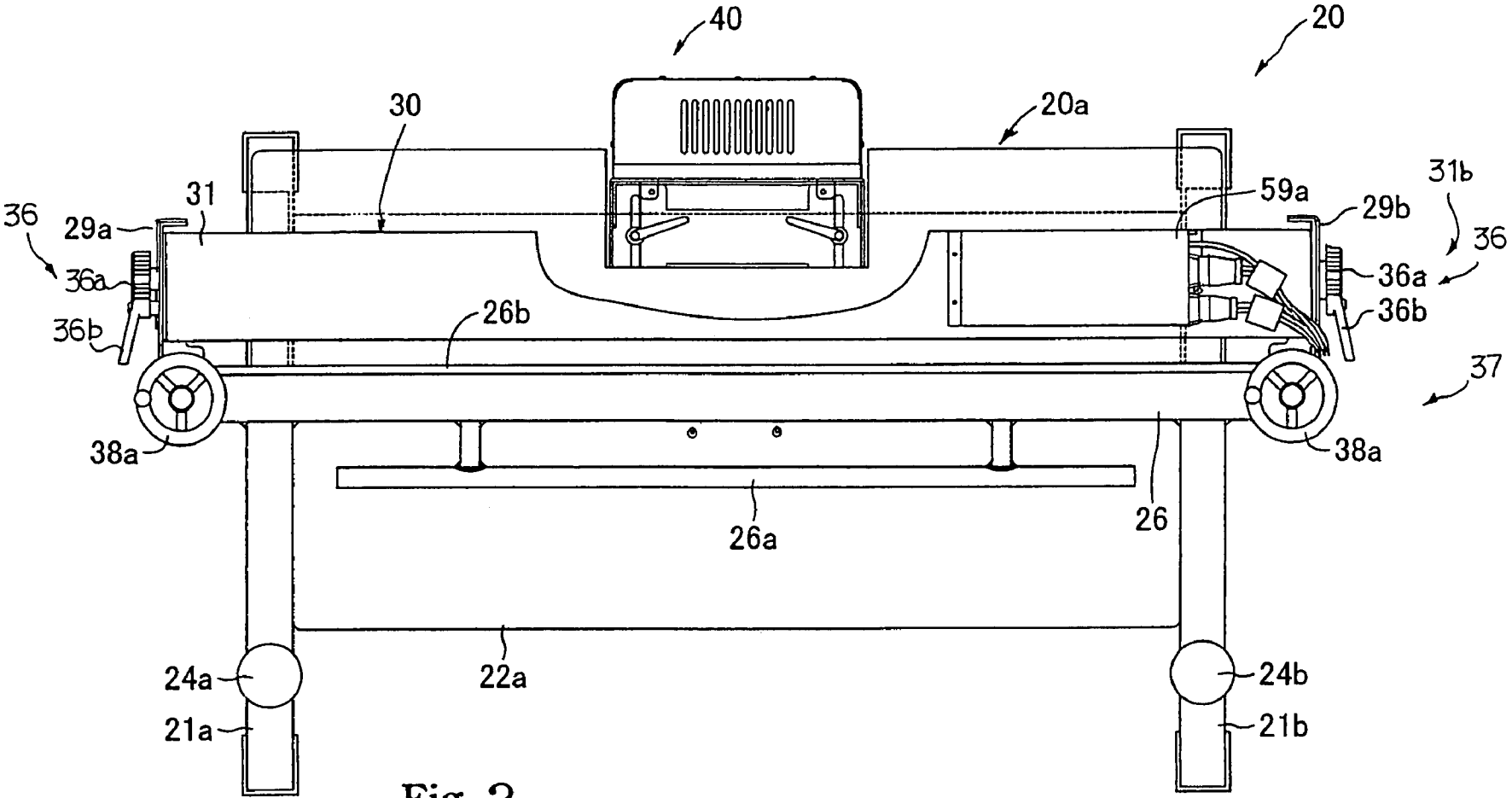
FIG. 2 is a plane view showing the separate automatic player.
Figure 3:
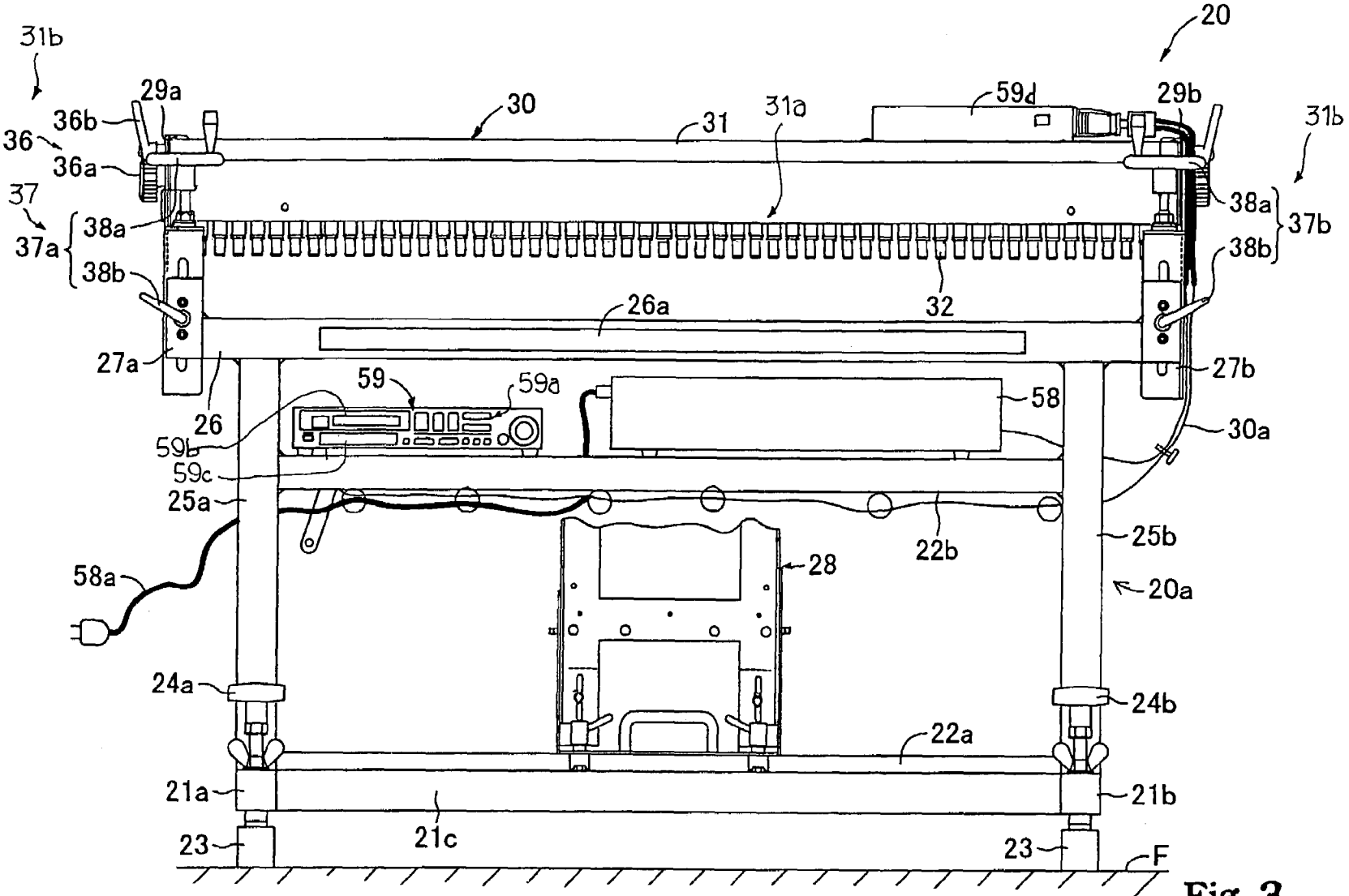
FIG. 3 is a partially cut-away front view showing the separate automatic player.
Figure 4:
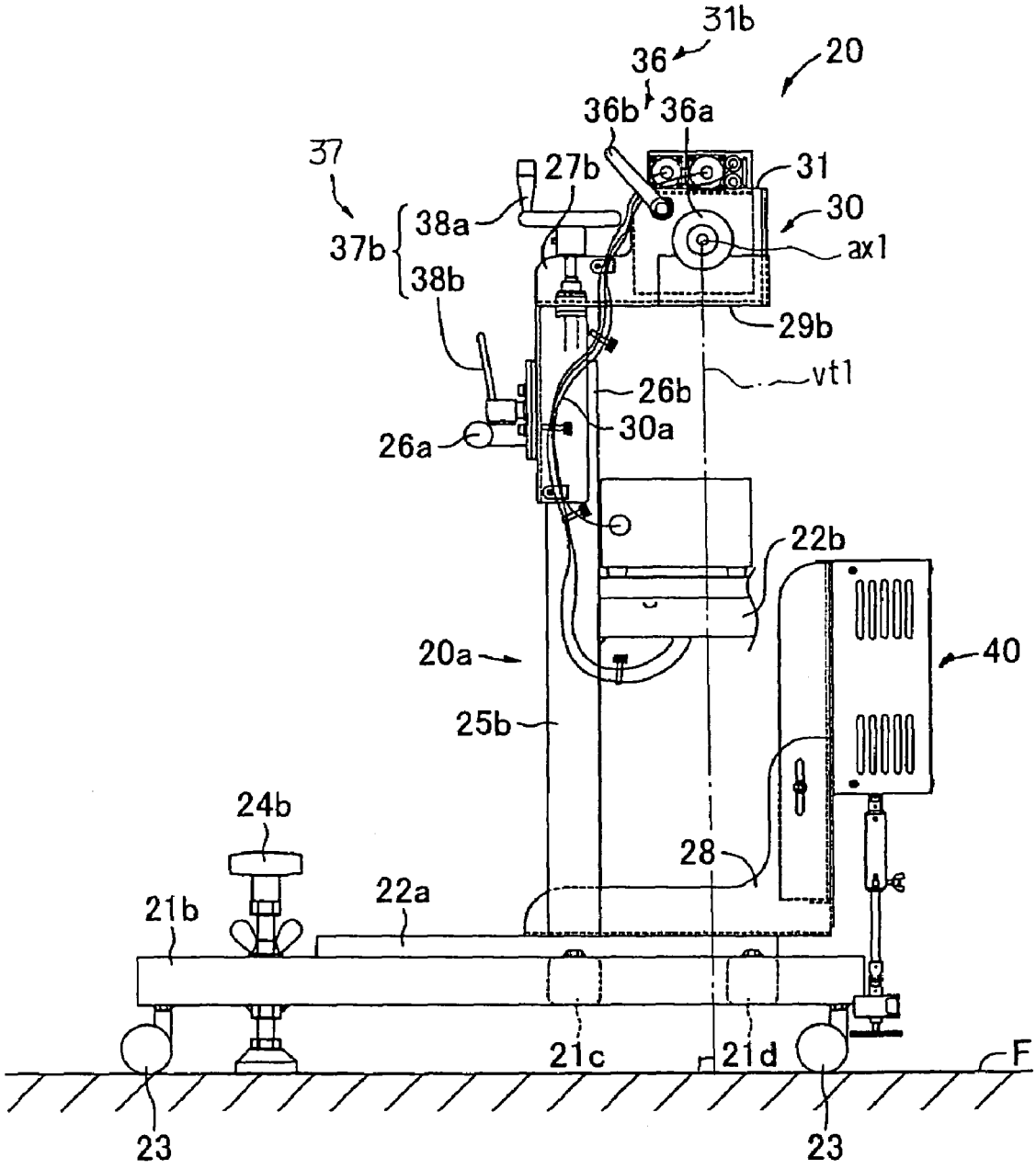
FIG. 4 is a side view showing the separate automatic player.

As will be better seen in FIGS. 2, 3 and 4, the framework 20*a* includes a pair of rigid bars 21*a*/21*b*, a pair of lateral bars 21*c*/21*d*, a base plate 22*a* and a pair of posts 25*a*/25*b*. The rigid bars 21*a* and 21*b* extend in the fore-and-aft direction in parallel to each other, and are spaced by a predetermined distance. The lateral bars 21*c* and 21*d* laterally extend between the rear portions of the rigid bars 21*a* and 21*b* in parallel to each other, and are connected at the right ends thereof to the rigid bar 21*a* and at the left ends thereof to the other rigid bar 21*b*. The lateral bar 21*d* is closer to the rear ends of the rigid bars 21*a*/21*b* than the other lateral bar 21*c*, and the lateral bar 21*c* is little bit offset from the middle points of the rigid bars 21*a*/21*b* toward the rear ends as shown in FIG. 4. The posts 25*a*/25*b* are upright on the rigid bars 21*a*/21*b*, and are located over the right end and left end of the lateral bar 21*c*. The base plate 22*a* has a rectangular top surface, and is connected to the rigid bars 21*a*/21*b* and lateral bars 21*c*/21*d* in such a manner as to bridge the gap between the rigid bars 21*a* and 21*b*. In other words, the gap between the rigid bars 21*a* and 21*b* is covered with the base plate 22*a* except the front zone.

The framework 20*a* further includes a deck plate 22*b*, an upper beam 26, a pair of brackets 27*a*/27*b* and a retainer 28. The deck plate 22*b* is fixed to the posts 25*a*/25*b*, and is spaced in parallel from the base plate 22*a*. The upper beam 26 is fixed to the upper ends of the posts 25*a*/25*b*. The upper beam 26 laterally extends in parallel to the deck plate 22*b* and base plate 22*a*, and sideward projects over the posts 25*a*/25*b*. The bracket 27*a* is fixed to one end of the upper beam 26, and the other bracket 27*b* is fixed to the other end of the upper beam 26. The brackets 27*a*/27*b* rearward project from the upper beam 26, and the key drive unit 30 is supported by the pair of brackets 27*a*/27*b*. When the framework 20*a* stands by for the automatic playing in front of the upright piano 10, the brackets 27*a*/27*b* keep the key drive unit 30 over the keyboard 12. The retainer 28 is provided in a central area of a rear portion of the base plate 22*a*, and is fixed to the rear portion of the base plate 22*a*. The retainer 28 has a pair of L-letter shaped brackets and a frame (see FIGS. 3 and 4), and upwardly projects over the upper surface of the base plate 22*a*. The pedal actuator unit 40 is connected to the rear surface of the retainer 28. When the separate automatic player 20 stands by for the automatic playing, the retainer 28 keeps the pedal actuator unit 40 over the pedals 16*a*, 16*b* and 16*c*.

A grip bar 26*a* is fixed to the front surface of the upper beam 26, and a cushion belt 26*b* is adhered to the rear surface of the upper beam 26. The grip bar 26*a* is spaced from the upper beam 26 so that a user moves the separate automatic player 20 by drawings and pushing the grip 26*a*. The cushion belt 26*b* extends on the entire rear surface of the upper beam 26, and prevents the piano cabinet 11 from scratches at the collision therebetween.

The framework 20*a* further includes casters 23 and an anchors 24*a*/24*b*. In this instance, a pair of jacks 24*a*/24*b* serves as the anchor. The casters 20*a* are connected to the front end portions and rear end portions of the rigid bars 21*a*/21*b*, and downwardly projects from the lower surfaces of the rigid bars 21*a*/21*b*. Thus, the casters 23 are located at the four corners of the framework 20*a*. The casters 23 are able to roll about vertical center axes thereof, and permit a user to move the separate automatic player 20 in an arbitrary direction on the floor FL. The jacks 24*a*/24*b* are provided through the front end portions of the rigid bars 21*a*/21*b*. The jacks 24*b*/24*b* are held in threaded engagement with the rigid bars 21*a*/21*b*, and are projectable from and retractable into the rigid bars 21*a*/21*b*. When the user wishes to maintain the separate automatic player 20 at a certain position, he or she screws the jacks 24*a*/24*b* into the rigid bars 21*a*/21*b*. The jacks 24*a*/24*b* exert the force on the floor FL, and make the front casters 23 float over the floor FL. On the other hand, when the user wishes to move the separate automatic player 20 to another area on the floor FL, he or she retracts the jacks 24*a*/24*b* into the framework 20*a*, and makes the front casters 23 brought into contact with the floor FL, again. Then, the four casters 23 roll on the floor FL, and permit the user to move the separate automatic player 20 to the area.

Thus, the framework 20*a* retains the key drive unit 30 and pedal drive unit 40 over the keyboard 12 and pedals 16*a*/16*b*/16*c* during the automatic playing, and permits the user to move the separate automatic player 20 to another piano.

Key Drive Unit

The key driver unit 30 is broken down into a key actuator unit and an adjusting unit. The key actuator unit is responsive to a driving current signal so as selectively to depress and release the black keys (not shown) and white keys 15, and the adjusting unit permits the user three-dimensionally to vary the key actuator unit over the keyboard 12. Thus, a user optimizes the key actuator unit with respect to the keyboard 12 by means of the adjusting unit so that the separate automatic player 20 produces the acoustic piano tones, which the listeners feel same as those in the original performance.

In detail, the key driver unit 30 includes a housing 31, an array of key actuators 31*a*, an attitude changer 31*b* and an alignment device 35. The housing 31 and array of key actuators 31*a* as a whole constitute the key actuator unit, and the attitude changer 31*b* and alignment device 35 form in combination the adjusting unit.

Figure 5:
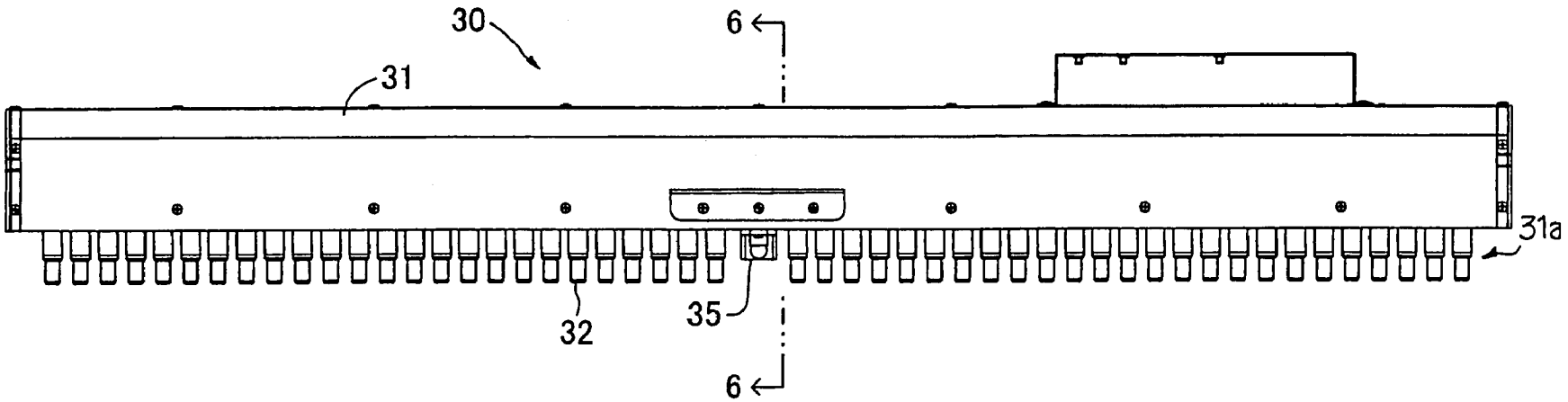
FIG. 5 is a front view showing a key driver unit incorporated in the separate automatic player.

An inner space is defined in the housing 31, and the array of key actuators 31*a* is installed in the inner space. The housing 31 is supported through the attitude changer 31*b* by the brackets 27*a*/27*b* so that the user can change the attitude of the array of key actuators 31*a* with respect to the keyboard 12 by manipulating the attitude changer 31*b*. The attitude changer 31*b* permits the user to change the gap between the array of key actuators 31*b* and the black keys (not shown) and white keys 15 and the inclination of the array of key actuators 31*b*. The alignment device 35 is also supported by the housing 31 (see FIG. 5), and radiates a light beam onto the keyboard 12. The user aligns the light beam to the boundary between a gap between predetermined keys 15. In this instance, the eighty-eight keys 15 form the array of key actuators 31*a*, and the alignment device 35 is located at a relative position corresponding to the gap between the forty-fourth key 15 and the forty-fifth key. For this reason, when the user aligns the light beam with the gap between the keys 15, the key actuators 31*a* are properly located over the associated black keys (not shown) and white keys 15.

Figure 6:
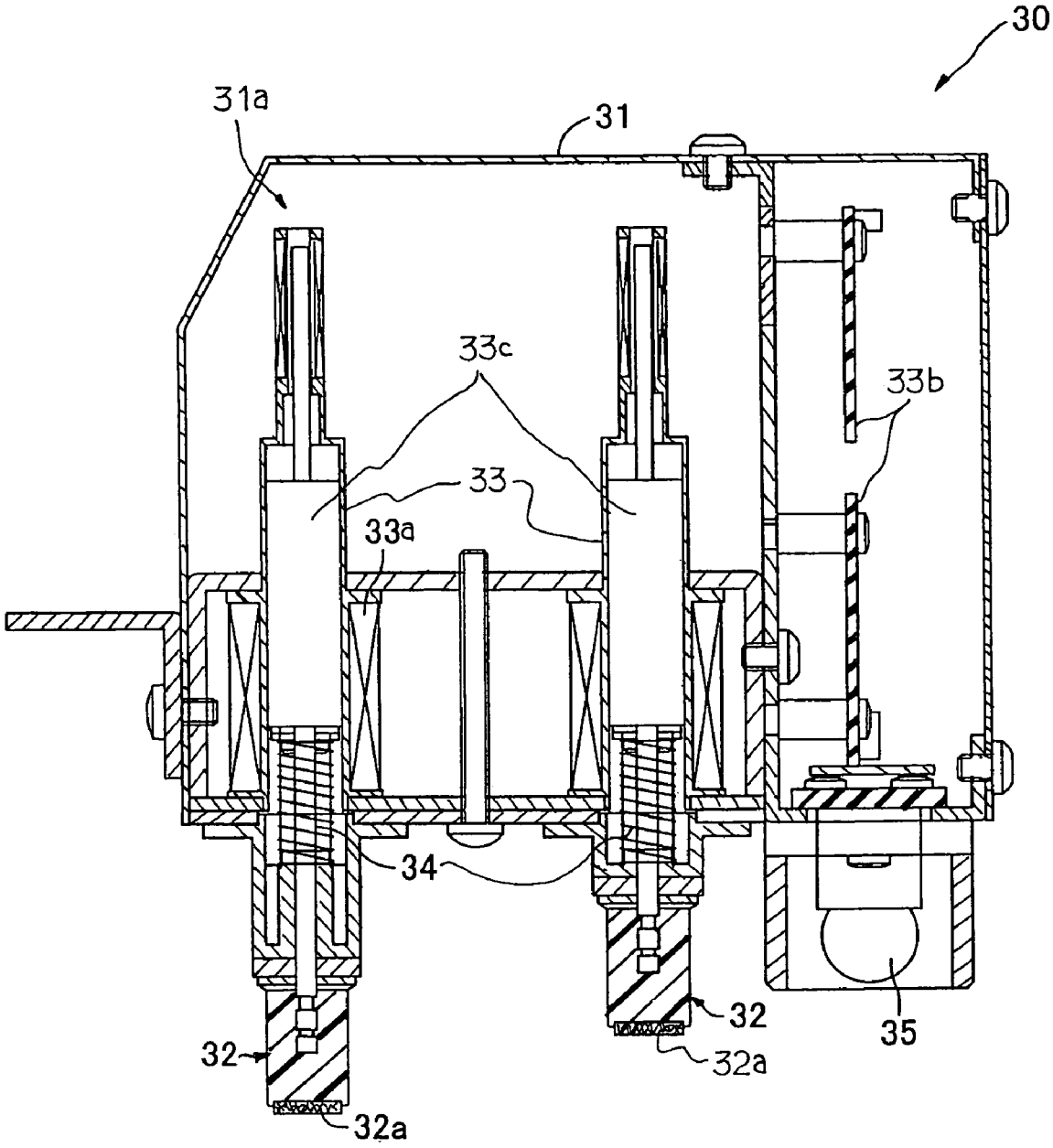
FIG. 6 is a cross sectional view taken along line 6-6 in FIG. 5, and showing solenoid-operated key actuators incorporated in the key driver unit.
Figure 7:
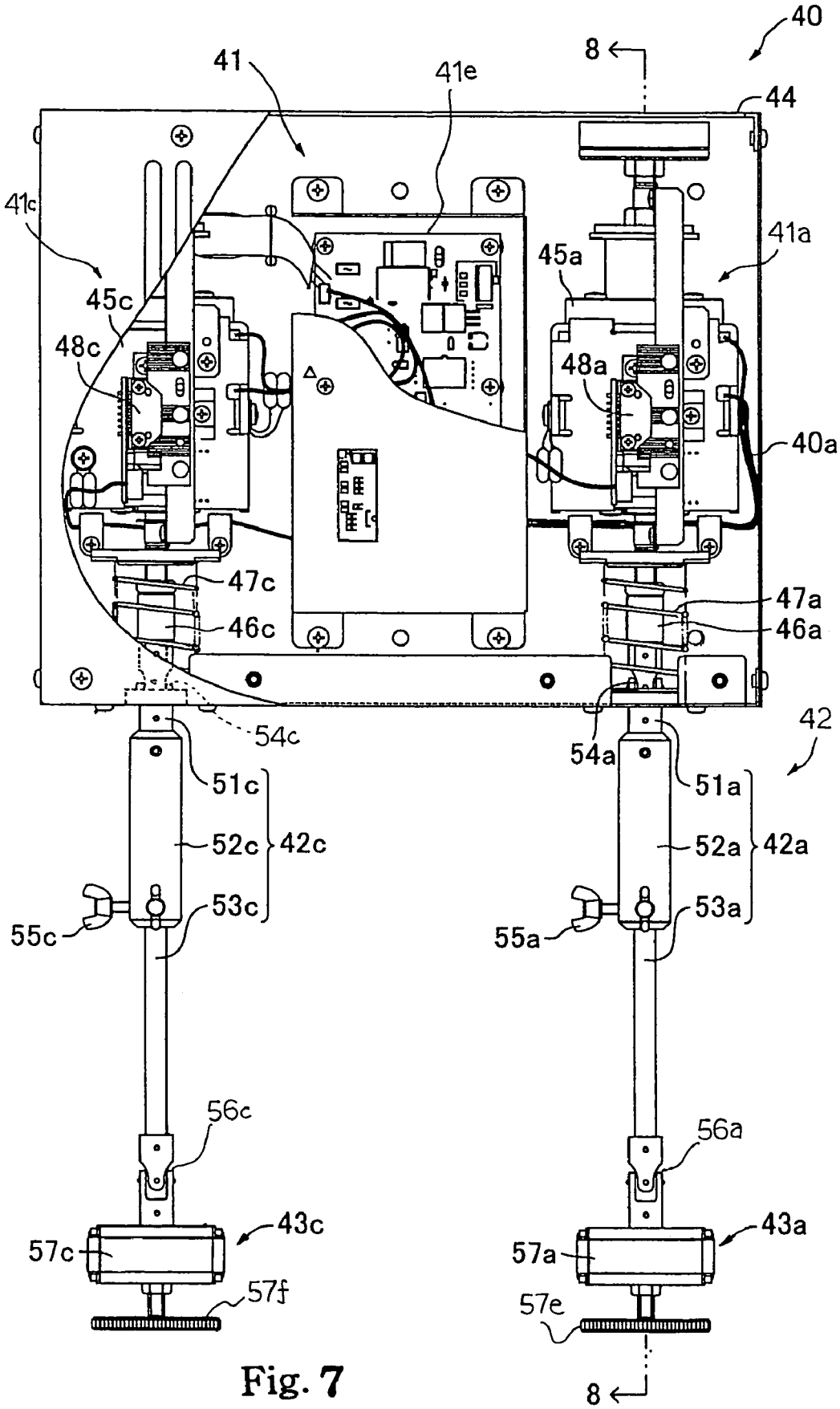
FIG. 7 is a partially cut-away front view showing the structure of a pedal driver unit.
Figure 8:
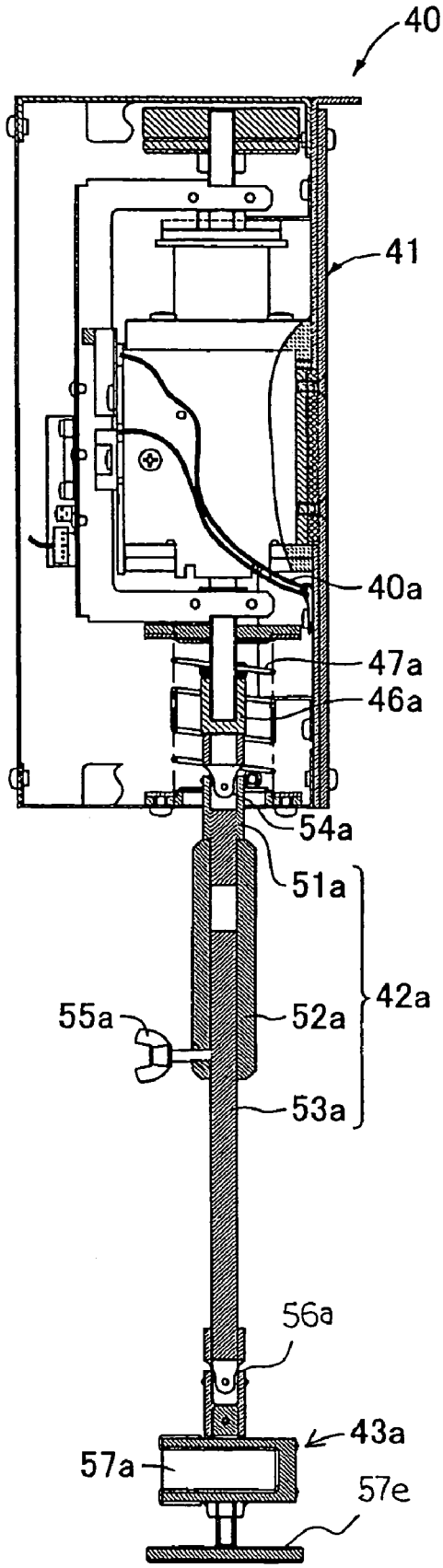
FIG. 8 is a cross sectional side view taken along line 8-8 in FIG. 7 and showing the structure of the pedal driver unit.

The housing 31 has a generally rectangular parallelepiped configuration, and yokes 33, on which solenoids 33*a* are wound, and a rigid circuit board 33*b*, on which a driver circuit (not shown) for the solenoids 33*a* are integrated, are bolted to the housing 31 as shown in FIG. 6. The yokes 33 and solenoids 33*a* form the array of key actuators 31*a* together with plunger heads 32, plungers 33*c* and return springs 34. The solenoids 33*a* are connected to the driver circuit (not shown), and the driving current signal is selectively supplied from the driver circuit (not shown) to the solenoids 33*a*. Power voltages are supplied to the driver circuit (not shown), and the driver circuit (not shown) is responsive to a control signal so as to adjust the driving signal to a target mean current and supply it to the solenoids as will be described hereinlater. The plungers 33*c* are movably inserted into the yokes 33, and the return springs 34 are inserted between the plungers 33*c* and the yokes 33. The return springs 34 always exert the elastic force on the associated plungers 33*c* in the upward direction so that the plungers 33*c* are retracted into the yokes 33. However, when the solenoids 33*a* are energized with the driving signal, the magnetic force is exerted on the associated plungers 33*c* in the downward direction, and downwardly project from the yokes 33. The plunger heads 32 are respectively secured to the lower ends of the plungers 33*c*, and have cushions 32*a* at the lower end thereof. In this instance, the cushions 32*a* are made of felt. The plungers 33*c* are brought into contact with the upper surfaces of the black keys (not shown) and the upper surfaces of the white keys 15 through the cushions 32*a*. The cushions 32*a* prevent the black keys (not shown) and white keys 15 from scratches, and extinguish noise at the strike.

The key actuators 31*a* are arranged in two rows, i.e., the front row assigned to the white keys 15 and the rear row assigned to the black keys (not shown). Since the black keys (not shown) have the height greater than the height of the white keys 15, the key actuators 31*a* for the black keys (not shown) have the plungers 33*c* shorter than those of the key actuators 31*a* for the white keys 15.

The attitude changer 31*b* permits the user three-dimensionally to change the attitude of the array of key actuators 31*b* with respect to the keyboard 12. In detail, a rotary unit 36 and an elevator 37 are incorporated in the attitude changer 31*b*. The rotary unit 36 is connected at one end to the housing 31 and at the other end to the elevator 37, and the elevator 37 is provided between the rotary unit 36 and the pair of brackets 27*a*/27*b*. The array of key actuators 31*a* has an axis of rotation ax1, which laterally extends between the rightmost key actuator 31*a* and the leftmost key actuator 31*a*, and the rotary unit 36 give rise to rotation of the array of key actuators 31*a* about the axis of rotation ax1. Thus, the rotary unit 36 causes the array of key actuators 31*a* to vary the angle of the key actuators 31*a* with respect to a virtual plane defined by the axis of rotation ax1 and a vertical line vt1 crossing the axis of rotation at right angle. On the other hand, the elevator 37 changes the distance between the axis of rotation and the brackets 27*a*/27*b*. The user independently moves up and down the both sides of the housing 31 by means of the elevator 37. For this reason, it is possible to make the housing 31 roll about a line in parallel to the fore-and-aft direction. Thus, the rotary unit 36 cooperates with the elevator 37 so as to optimize the attitude of the housing 31 and, accordingly, the array of key actuators 31*a* with respect to the keyboard 12. The rotary unit 36 includes a pair of brackets 29*a*/29*b*, a pair of side locks 36*a* and a pair of handles 36*b*. The brackets 29*a*/29*b* are respectively provided on both sides of the housing 31, and are supported by the elevator 37. The housing 31 is rotatably connected between the brackets 29*a* and 29*b*, and is secured to and released from the brackets 29*a* and 29*b*. The side locks 36*a* are supported by the brackets 29*a* and 29*b*. The side locks 36*a* makes the housing 31 pressed to the brackets 29*a* and 29*b*, and releases the housing 31 from the brackets 29*a* and 29*b* so as to permit the user to rotate the housing about the axis of rotation. The pair of handles 36*b* is connected to the housing 31, and offers a long radius of curvature to the user. When the user wishes to change the angle of the key actuators 31*a*, he or she manipulates the side locks 36*a*/36*b* so as to release the housing 31 from the brackets 29*a*/29*b*, and rotates the housing 31 with the handle 36*b*. When the center axes of the plungers 33*c* become normal to the upper surfaces of the black keys (not shown) and the upper surfaces of the white keys 15, he or she stops the rotation, and locks the housing 31 to the brackets 29*a*/29*b* by means of the side locks 36*a*, again.

The elevator 37 includes a pair of motion converters 38*a* and a pair of locks 38*b*. One of the motion converters 38*a* is provided in association with one of the locks 38*b* so as to form a side elevator 37*a*, and the other motion converter 38*a* and the other lock 38*b* also form another side elevator 37*b*. The side elevators 37*a* is provided between the bracket 27*a* and the bracket 29*a*, and the other side elevator 37*b* is provided between the other bracket 27*b* and the other bracket 29*b*. Since the side elevators 37*a* and 37*b* are independent of each other, the user may manipulate either side elevator 37*a* or 37*b* so as to make the housing 31 roll about the line in parallel to the fore-and-aft direction.

The motion converters 38*a* have respective wheels (see FIG. 2), and are rotatable about centerlines thereof vertical to the floor FL. The motion converters 38*a* convert the rotation of the wheels to the linear motion of the associated brackets 29*a*/29*b*. For this reason, the user moves the brackets 29*a*/29*b* upwardly and downwardly by manipulating the motion converters 38*a*. The locks 38*b* are respectively provided for the motion converters 38*a*, and permit the motion converters 38*a* to move the brackets 29*a*/29*b* in the up-and-down direction and keep-them at the current positions. When the user wishes to change the gap between the keyboard 12 and the plunger heads 32, he or she loosens the locks 38*b*, and moves the housing 31 upwardly and/or downwardly by means of the motion converters 38*a*. The user confirms that the gap is proper, then, he or she tightens the locks 38*b*, and makes the housing 31 unmoved.

As will be understood from the foregoing description, the user can optimize the attitude of the array of key actuators 31*a* over the keyboard 12 through the attitude changer 31*b*. In other words, the plunger heads 32 are evenly spaced from the associated black keys (not shown) and white keys 15, and the centerlines of the plungers 31*c* are normal to the upper surfaces of the black keys (not shown) and upper surfaces of the white keys 15. In this situation, the separate automatic player 20 gives rise to same key motion as that in the original performance on the basis of a reference piece of music data, and the listener feels the acoustic piano tones produced in the automatic playing identical with the original acoustic piano tones.

Pedal Actuator Unit

The pedal actuator unit 40 is broken down into a pedal actuator unit 41 and an adjuster 42. In this instance, the pedal actuator unit 40 drives the soft and damper pedals 16*a*/16*c* so that the muffler pedal 16*b* stands idle in the automatic playing. The pedal actuator 41 is responsive to a driving current signal so as selectively to step on the soft and damper pedals 16*a*, 16*b* and 16*c*. On the other hand, the adjuster 42 permits a user to optimize the relative position between the pedal actuator unit 41 and the soft and damper pedals 16*a*, 16*b* and 16*c*.

In detail, the pedal actuator unit 40 includes a housing 44, pedal actuators 41*a*/41*c*, a driver circuit 41*e*, universal joints 42*a*/42*c* and pedal clamps 43*a*/43*c*. The universal joints 42*a*/42*c* serves as the adjuster 42, and the housing 44, pedal actuators 41*a*/41*c* and pedal clamps 43*a*/43*c* as a whole constitute the pedal actuator unit 41. The housing 44 is supported by the framework 20*a*, and the brackets 28 keeps the housing 44 over the pedals 16*a*, 16*b* and 16*c* as described hereinbefore.

The pedal actuators 41*a*/41*c* and driver circuit 41*e* are provided inside the housing, and the driving current signal is selectively supplied from the driver circuit 41*e* to the pedal actuators 41*a*/41*c*. The soft pedal 16*a* and damper pedal 16*c* are clamped with the pedal clamps 43*a* and 43*c*, and the universal joints 42*a*/42*c* are inserted between the pedal actuators 41*a*/41*c* and the pedal clamps 43*a*/43*c*, respectively. The universal joints 42*a*/42*c* take up misalignment between the pedal actuators 41*a*/41*c* and the pedal clamps 43*a*/43*c*, and permits the pedal actuators 41*a*/41*c* vertically to exert the force on the soft pedal 16*a* and damper pedal 16*c* through the pedal clamps 43*a*/43*c*.

In more detail, the pedal actuators 41*a*/41*c* includes respective solenoids 45*a*/45*c*, respective plungers 46*a*/46*c*, respective return springs 47*a*/47*c* and respective plunger sensors 48*a*/48*c*. The solenoids 45*a*/45*c* are connected to the driver circuit 41, and the plungers 46*a*/46*c* downwardly project through the solenoids 45*a*/45*c*, respectively. The return springs 47*a*/47*c* is respectively inserted between the housing 44 and the plungers 46*a*/46*c*, and urges the plungers 46*a*/46*c* upwardly. For this reason, the plungers 46*a*/46*c* are retracted in the solenoids 45*a*/45*c* in the absence of the driving current signal. While the driving current signal is flowing through the solenoids 45*a*/45*c*, the solenoids 45*a*/45*c* create the magnetic fields around the plungers 46*a*/46*c* so as to exert the magnetic force on the plungers 46*a*/46*c*. The plungers 46*a*/46*c* downwardly project from the solenoids 45*a*/45*c* against the return springs 47*a*/47*c*, and pushes down the pedal clamps 43*a*/43*c* through the universal joints 42*a*/42*c*.

The universal joints 42*a*/42*c* includes respective upper rods 51*a*/51*c*, respective intermediate cylinders 52*a*/52*c*, respective lower rods 53*a*/53*c*, respective upper joints 54*a*/54*c*, bolts 55*a*/55*c* and respective lower joints 56*a*/56*c*. The upper rods 51*a*/51*c* are respectively connected at the upper end portions thereof to the lower end portions of the plungers 46*a*/46*c* by means of the upper joints 54*a*/54*c*, and the lower end portions of the upper rods 51*a*/51*c* are respectively inserted into the intermediate cylinders 52*a*/52*c*. The upper rods 51*a*/51*c* are secured to the intermediate cylinders 52*a*/52*c* by means of pins. The lower rods 53*a*/53*c* are respectively connected at the lower ends thereof to the pedal clamps 43*a*/43*c* by means of the lower joints 56*a*/56*c*, and the soft pedal 16*a* and damper pedal 16*c*, which have been inserted into gaps 57*s*/57*c*, are pressed to the inner surfaces of the pedal clamps 43*a*/43*c* by means of bolts 57*e* and 57*f*.

The upper portions of the lower rods 53*a*/53*c* are slidably inserted into the intermediate cylinders 52*a*/52*c*, respectively, and the upper portions of the lower rods 53*a*/53*c* are fixed to the intermediate cylinders 52*a*/52*c* by means of the bolts 55*a*/55*c*. When the user loosens the bolts 55*a*/55*c*, the lower rods 53*a*/53*c* become slidable in the intermediate cylinders 52*a*/52*c*. For this reason, the user adjusts the total length of the universal joints 42*a*/42*c* to the distance between the lower ends of the plungers 46*a*/46*c* and the soft and damper pedals 16*a*/16*c* by pushing the lower rods 53*a*/53*c* into and/or pulling out them from the intermediate cylinders 52*a*/52*c*, and drives the bolts 55*a*/55*c* into the intermediate cylinders 52*a*/52*c* for fixing the total length to the distance.

The upper joints 54*a*/54*c* have respective pairs of pins, and keep themselves inside the housing 44. The pins of each upper joint 54*a*/54*c* cross each other at right angle, and are rotatably connected to the lower end portions of the plungers 46*a*/46*c* and the upper end portions of the upper rods 51*a*/51*c*. For this reason, the upper joints 54*a*/54*c* permit the centerlines of the associated plungers 46*a*/46*c* to cross the centerlines of the upper rods 51*a*/51*c* at an arbitrary angle.

Similarly, the lower joints 56*a*/56*c* have respective pairs of pins. The pins of each lower joint 56*a*/56*c* cross each other at right angle, and are rotatably connected to the lower end portions of the lower rods 53*a*/53*c* and the upper end portions of the pedal clamps 43*a*/43*c*. For this-reason, the lower joints 56*a*/56*c* permit the centerlines of the associated lower rods 53*a*/53*c* to cross the centerlines of the pedal clamps 43*a*/43*c* at an arbitrary angle.

The upper and lower joints 54*a*/56*a* and 54*c*/56*c* permit the centerlines of the plungers 46*a*/46*c* to cross the centerlines of the pedal clamps 43*a*/43*c* at an arbitrary angle, and the intermediate cylinders 52*a*/52*c* and lower rods 53*a*/53*c* allow the total length of the universal joints 42*a*/42*c* and pedal clamps 43*a*/43*c* to be adjusted to the distance between the plungers 46*a*/46*c* and the pedal clamps 43*a*/43*c*. Thus, the user can optimize the relative position between the pedal actuators 41*a* and the soft and damper pedals 16*a*/16*c* by means of the adjuster 42.

Even if the centerlines of the plungers 46*a*/46*c* are offset from the centerlines of the pedal clamps 43*a*/43*c*, the plungers 46*a*/46*c* are connected through the universal joints 42*a*/42*c* to the pedal clamps 43*a*/43*c*, and the force is transmitted from the plungers 46*a*/46*c* through the universal joints 42*a*/42*c* to the pedal clamps 43*a*/43*c*. Moreover, the bolts 57*e*/57*f* keep the soft and damper pedals 16*a*/16*c* stable in the gaps 57*a*/57*c*. The bolts 57*e*/57*f* do not permit the soft and damper pedals 16*a*/16*c* to be separated from the pedal clamps 43*a*/43*c*, and prevent the soft and damper pedals 16*a*/16*c* from undesirable chattering. Thus, the force is surely exerted on the soft and damper pedals 16*a*/16*c* without any noise.

Additionally, the peal actuators 41*a*/41*c*, universal joints 42*a*/42*c* and pedal clamps 43*a*/43*c* are connected in series in the up-and-down direction so that the pedal driver unit 40 merely occupies a space narrower than the space occupied by the prior art pedal actuator disclosed in the U.S. patent.

Electronic System

Turning back to FIG. 3 of the drawings, a power source unit 58 and a controller 59 are put on the deck plate 22*b*. The power source unit 58 is rechargeable through a power cable 58*a*. Electric power is supplied from the power source unit 58 to the controller 59 and the driver circuits 33*b*/41*e*. Though not shown in the drawings, a data processor, a program memory and a working memory are incorporated in the controller 59, and the data processor is communicable with a local controller 59*d* and the driver circuit/plunger sensors 41*e*/48*a*/48*c* through cables 30*a* and 40*a*. The local controller 59 is connected to the driver circuit 33*b* and plunger sensors, which respectively monitor the plungers 33*c*, and carries out the feedback control on the key actuators 31*a*.

Upon completion of an initialization, a main routine program runs on the data processor, and conditionally branches to subroutine programs. While the data processor reiterates the main routine program, the data processor fetches user's instructions, which are given through buttons 59*a*, and produces visual images, which express current status of the data processing and/or prompt messages to the user, on a display window 59*b*.

A user is assumed to request the controller 59 a playback. The data processor reads out the titles of pieces of music from a compact disk on a tray 59*c*, and prompts the user to select a piece of music to be reproduced through the display window 59*b*. When the user specifies the piece of music to be reproduced, the data processor transfers a set of music data codes representative of the piece of music from the compact disk to the working memory, and starts the automatic playing.

While the data processor is sequentially processing the music data codes, the array of key actuators 31*a* and pedal actuators 41*a*/41*c* project and retracts the plungers 33*c*/46*a*/46*c* on the basis of the control signals supplied from the local controller 59*a* and controller 59 so as selectively to give rise to the key motion of black keys (not shown), key motion of white keys 15 and pedal motion of soft and damper pedals 16*a*/16*c*. The controller 59 takes the feedback signal supplied from the plunger sensors 48*a*/48*c* into account, and exactly controls the soft and damper pedals 16*a*/16*c*. The local controller 59*d* also forms the feedback control loops together with the plunger sensors, and exactly controls the black keys (not shown) and white keys 15. In other words, the separate automatic player 20 gives rise to not only the key motion but also the pedal motion in the automatic playing as similar to the human player in the original performance. The depressed black keys (not shown) and depressed white keys make the strings 10*c* produce the acoustic piano tones at the loudness equal to that in the original performance, and the effects are surely imparted to the selected acoustic piano tones. Thus, the separate automatic player reenacts the original performance without any fingering of a human pianist.

Setting Work

Subsequently, description is made on how the separate automatic player 20 is located at the proper relative position with respect to the upright piano 10. The jacks 24*a*/24*b* have been lifted over the floor FL, and the housing 31 and, accordingly, the array of key actuators 31*a* have been high enough not to be brought into collision with the keyboard 12. Moreover, the user have rearward turned the fall board 14 so as to expose the keyboard 12.

First, the user grips the grip bar 26*a*, and pushes and/or pulls the separate automatic player 20 so as to bring it near the upright piano 10. When the cushion belt 26*b* is brought into contact with the key slip, which defines the front boundary of the piano cabinet 11, the user stops the separate automatic player 20, and connects the power cable 58*a* to a socket.

Subsequently, the user turns on the alignment device 35. Then, the light beam is fallen onto the keyboard 12, and the user laterally moves the separate automatic player 20 until the light beam is aligned with the boundary between the predetermined keys 15. When the light beam is aligned with the boundary, the user moves down the jacks 24*a*/24*b*, and presses the jacks 24*a*/24*b* against the floor FL so as to make the front casters 23 float over the floor FL. When the jacks 24*a*/24*b* make the front casters 23 float over the floor FL by 5 millimeters, the user stops the jacks 24*a*/24*b*. The jacks 24*a*/24*b* do not permit the separate automatic player 20 unintentionally to move on the floor FL, and keep it stable on the floor FL. Thereafter, the user turns off the alignment device 35 so that the light is extinguished. Thus, the framework 20*a* is properly located at a target position with respect to the upright piano 10.

Subsequently, the user adjusts the key actuator unit 30 and pedal actuator unit 40 to proper angles and target distances. The user may firstly work on the key actuator unit 30 and, thereafter, on the pedal actuator unit 40 or vice versa. In detail, the user manipulates the locks 38*b* so as to release the elevator 37, and rotates the motion converters 38*a*/38*b* so as to move the housing 31 and, accordingly, the array of key actuators 31*a* downwardly. When all the plunger heads 32 are brought into contact with the upper surfaces of the associated black keys (not shown) and the upper surfaces of the associated white key 15, the user stops rotating, and locks the elevator 37, again. Although the plunger heads 32 are held in contact with the upper surfaces of the black keys (not shown) and the upper surfaces of the white keys 15, the centerlines of the plungers 33*c* may not be normal to the upper surfaces. For this reason, the user releases the rotary unit 36, and rotates the housing 31 and, accordingly, array of key actuators 31*a*. The angle between the centerlines of the plungers 33*c* and the virtual plane is varied. When the centerlines of the plungers 33*c* lie on the virtual plane, the user stops the rotation, and locks the rotary unit 36, again. In this situation, all the key actuators 31*a* are assumed to be energized at a predetermined amount of electric power. The plungers 33*c* exert force, the magnitude of which is equivalent to the predetermined amount of electric power, on the associated black keys (not shown) and associated white keys 15 without irregularity, and give rise to the key motion same as that in the original performance. This results in that the listeners feel the automatic playing same as the original performance.

The user adjusts the pedal driver unit 40 to the target length equal to the distance between the plungers 46*a*/46*c* and the soft and damper pedals 16*a*/16*c* as follows. Firstly, the user loosens the bolts 55*a*/55*c*, and permits the lower rods 53*a*/53*c* to be moved into and out of the intermediate cylinders 52*a*/52*c*. The user aligns the pedal clamps 43*a* and 43*c* with the soft and damper pedals 16*a* and 16*c*, and pushes the pedal clamps 43*a* and 43*c* toward the soft and damper pedals 16*a* and 16*c*. Then, the soft and damper pedals 16*a* and 16*c* are received in the spaces 57*a* and 57*c*. While the user is moving the pedal clamps 43*a* and 43*c*, the lower rods 53*a*/53*c* are moved into and out of the intermediate cylinders 52*a*/52*c* so as to increase and decrease the length, and the upper joints 54*a*/54*c* and lower joints 56*a*/56*c* permits the user to move the pedal clamps 43*a*/43*c* in the lateral direction and fore-and-aft direction. When the user confirms the soft and damper pedals 16*a*/16*c* received in the spaces 57*a*/57*c*, he or she drives the bolts 57*e*/57*f* into the pedal clamps 43*a*/43*c*, and fixes the soft and damper pedals 16*a*/16*c* to the pedal clamps 43*a*/43*c*, respectively.

When the user wishes to perform a piece of music on the keyboard through his or her fingering, he or she lifts the housing 31 and, accordingly, array of key actuators 31*a*, and spaces the jacks 24*a*/24*b* from the floor FL. Then, the casters 23 are allowed to roll on the floor FL, again. The user pulls the grip handle 26*a*, and moves the separate automatic player 20 to another area remote from the upright piano 10. The user puts a stool in front of the upright piano 10, and sits on the stool for the fingering.

As will be appreciated from the foregoing description, the separate automatic player 20 according to the present invention is equipped with the pedal driver unit 40 together with the key driver unit 30. The key driver unit 30 selectively depresses and releases the black keys (not shown) and white keys 15 on the basis of the pieces of music data, and the pedal driver unit 40 steps on and releases the soft and damper pedals 16*a*/16*b* so as to impart the effects to selected acoustic piano tones. Thus, the separate automatic player 20 according to the present invention faithfully reenacts the original performance without any fingering of a human pianist.

Moreover, the separate automatic player 20 is equipped with the cushion belt/casters 26*b*/23 and alignment device 35. The casters 23 permit a user smoothly to move the framework 20*a* on the floor FL, and the cushion belt and alignment device 35 make the framework 20*a* stand at the target position in front of the upright piano 10. Thus, the user easily brings the separate automatic player 20 exactly to the target position with respect to the upright piano 10.

Furthermore, the key driver unit 30 is equipped with not only the elevator 37 but also the rotary unit 36. The elevator 37 not only causes the array of key actuators 31*a* to advance to the keyboard 12 but also make the array: of actuators 31*a* in parallel to the array of black keys and white keys 15 through the cooperation between the side elevators 37*a* and 37*b*. On the other hand, the rotary unit 36 makes the plungers 33*c* vertical to the upper surfaces of the black keys (not shown) and the upper surfaces of the white keys 15. As a result, all the key actuators 31*a* exert the force on the black keys (not shown) and white keys 15 on the same condition. This means that the force is exerted on the black keys (not shown) and white keys 15 at the magnitude expressed by the pieces of music data. This results in that the key driver unit 30 gives rise to the key motion same as that in the original performance.

Another advantage of the cooperation between the elevator 37 and the rotary unit 36 is that the separate automatic player 20 is available for different models of the acoustic pianos. Even if the keyboards are different in height, even if the keyboards are differently sloped, the array of key actuators 31*a* are surely brought into contact with the upper surfaces of the black/white keys, and keeps the plungers 33*c* vertical to the upper surfaces of the black/white keys.

Although particular embodiments of the present-invention have been shown and described, it will be apparent to those skilled in the art that various changes and modifications may be made without departing from the spirit and scope of the present invention.

For example, a pedal driver unit may have three sets of pedal actuators, universal joints and pedal clamps, which are respectively assigned to the soft, muffler and damper pedals 16*a*, 16*b* and 16*c*.

A set of music data codes may be supplied from an external data source to the controller 59 through a public or private network.

The upright piano 10 does not set any limit to the technical scope of the present invention. The separate automatic player 20 may be used for an automatic playing on a grand piano. The acoustic piano, i.e., the upright and grand pianos, do not set any limit to the technical scope of the present invention. The separate automatic player 20 may reenact a performance on a mute piano, in which a hammer stopper and an electronic tone generating system are installed.

The two pedal actuators 41*a*/41*c* do not set any limit to the technical scope of the present invention. More than two or three pedal actuators may be incorporated in a pedal driver unit according to the present invention. A separate automatic player equipped with more than three pedal actuators may perform a piece of music on an electronic keyboard. The separate automatic player may be combined with a harpsichord or a celesta.

The solenoid-operated key actuators 31*a* and solenoid-operated pedal actuators 41*a*/41*c* do not set any limit to the technical scope of the present invention. The solenoid-operated key actuators 31*a* and solenoid-operated pedal actuators 41*a*/41*c* may be replaced with pneumatic actuators or electric motors.

In the above-described embodiment, the rotary unit is provided between the elevator and the housing. However, this feature does not set any limit to the technical scope of the present invention. In a modification, the rotary unit is supported by the framework, and the elevator is provided between the rotary unit and the housing. Another modification may have an elevator and a rotary unit connected in parallel to the housing 31.

Motors, hydraulic actuators, or pneumatic actuators may be connected to the axis of rotation ax1 and the brackets 29*a*/29*b*. In this instance, the user changes the attitude of the housing 31 with the assistance of the motors, hydraulic actuators or pneumatic actuators.

The pair of side elevators 37*a*/37*b* may be replaced with a single elevator.

The component parts of the embodiment are correlated with claim languages as follows. The housing 31 and array of key actuators 31*a* as a whole constitute a "key actuator unit", and the elevator 37 and rotary unit 36 serve as a "first regulator" and a "second regulator", respectively. The axis of rotation ax1 and vertical line vt1 are corresponding to a "lateral line" and a "vertical line", respectively.

The cushion belt 26*b* and alignment device 35 as a whole constitute a "locator", and are corresponding to a "first locating device" and a "second locating device", respectively.

What is claimed is:

1. A separate automatic player independent of a keyboard musical instrument having a fore-and-aft direction, a lateral direction crossing said fore-and-aft direction at right angle and an up-and-down direction normal to a plane defined by said fore-and-aft direction and said lateral direction, comprising:

a key driver unit including a key actuator unit having an array of key actuators selectively driving keys of said keyboard musical instrument for producing tones, a first regulator connected to said key actuator unit and moving said key actuator unit in said up-and-down direction so as to make said array of said keys in parallel to the upper surfaces of said keys, and a second regulator connected to said key actuator unit and rotating said key actuator unit about a lateral line extending in parallel to said lateral direction so as to vary an angle between centerlines of said key actuators and a virtual plane defined by said lateral line and a vertical line normal to a floor where said keyboard musical instrument stands; and a pedal driver unit selectively stepping on pedals of said keyboard musical instrument.

2. The separate automatic player as set forth in claim 1, in which said second regulator keeps said centerlines of said key actuators normal to said upper surfaces of said keys staying at respective rest positions so that said key actuators independently exert force on said upper surfaces of said keys in directions vertical to said upper surfaces.

3. The separate automatic player as set forth in claim 2, in which said second regulator includes a handle exerting moment on said key actuator unit so as to give rise to the rotation of said key actuator unit about said lateral line, and a lock mechanism prohibiting said key actuator unit from said rotation.

4. The separate automatic player as set forth in claim 2, in which said first regulator cooperates with said second regulator so as to keep lower end portions of said key actuators vertically held in contact with said upper surfaces of said keys at said rest positions.

5. The separate automatic player as set forth in claim 4, in which said second regulator includes a motion converter driven for rotation so as to convert the rotation to linear motion of said key actuator unit in said up-and-down direction, and a lock mechanism prohibiting said key actuator unit from said linear motion.

6. The separate automatic player as set forth in claim 4, in which said first regulator includes a first elevator connected to one end portion of said actuator unit so as to give rise to linear motion of said key actuator unit in said up-and-down direction, a second elevator connected to another end portion of said actuator unit so as to give rise to linear motion of said key actuator unit in said up-and-down direction independently of said first elevator, and locks independently prohibiting said first elevator and said second elevator from said liner motion.

7. The separate automatic player as set forth in claim 1, in which said pedal driver unit includes pedal actuators for independently exerting force on said pedals, pedal clamps fixed to said pedals, and universal joints connected between said peal actuators and said pedal clamps so as to take up misalignment between said pedal actuators and said pedal clamps.

8. The separate automatic player as set forth in claim 7, in which said universal joints have respective telescopic portions so as to vary the length of said universal joints and locks prohibiting said telescopic portions from changing said length.

9. The separate automatic player as set forth in claim 1, in which said keyboard musical instrument is an acoustic piano having black keys, white keys and at least two pedals so that said black and white keys and said at least two pedals are driven by means of said key actuators and pedal actuators of said pedal driver unit.

10. The separate automatic player as set forth in claim 9, in which said first regulator cooperates with said second regulator so as to keep lower end portions of said key actuators vertically held in contact with said upper surfaces of said black and white keys staying at said rest positions.

11. The separate automatic player as set forth in claim 10, in which said second regulator includes a motion converter driven for rotation so as to convert the rotation to linear motion of said key actuator unit in said up-and-down direction, and a lock mechanism prohibiting said key actuator unit from said linear motion.

12. The separate automatic player as set forth in claim 10, in which said first regulator includes a first elevator connected to one end portion of said actuator unit so as to give rise to linear motion of said key actuator unit in said up-and-down direction, a second elevator connected to another end portion of said actuator unit so as to give rise to linear motion of said key actuator unit in said up-and-down direction independently of said first elevator, and locks independently prohibiting said first elevator and said second elevator from said liner motion.

13. The separate automatic player as set forth in claim 9, in which said pedal driver unit further includes pedal clamps fixed to said pedals, and universal joints connected between said peal actuators and said pedal clamps so as to take up misalignment between said pedal actuators and said pedal clamps.

14. The separate automatic player as set forth in claim 13, in which said universal joints have respective telescopic portions so as to vary the length of said universal joints and locks prohibiting said telescopic portions from changing said length.

15. The separate automatic player as set forth in claim 1, further comprising a framework supporting said key driver unit over said keyboard and said pedal driver unit over said pedals and movable on said floor.

16. The separate automatic player as set forth in claim 15, in which said framework includes casters rolling on said floor, and an anchor prohibiting said casters from rolling on said floor.

17. The separate automatic player as set forth in claim 16, in which a pair of jacks serves as said anchor.

18. The separate automatic player as set forth in claim 15, further comprising a locator supported by said framework and assisting a user to locate said framework at a target relative position with respect to said keyboard musical instrument.

19. The separate automatic player as set forth in claim 18, in which said locator includes a first locating device making said key driver unit and said pedal driver unit spaced by respective proper distances from a cabinet of said keyboard musical instrument in said fore-and-aft direction, and a second locating device making said key actuators and said peal actuators laterally aligned with said keys and said pedals.

20. The separate automatic player as set forth in claim 19, in which said first locating device and said second locating device are implemented by a cushion belt brought into contact with a front surface of said cabinet and a light radiating device radiating a light beam to said keyboard, respectively.

* * * * *

UNITED STATES PATENT AND TRADEMARK OFFICE

CERTIFICATE OF CORRECTION

PATENT NO. : 7,355,109 B2
APPLICATION NO. : 11/091866
DATED : April 8, 2008
INVENTOR(S) : Shigeru Muramatsu et al.

It is certified that error appears in the above-identified patent and that said Letters Patent is hereby corrected as shown below:

Column 15, Line 4, Claim 6:
"liner" should be --linear--

Column 15, Line 10, Claim 7:
"peal" should be --pedal--

Column 15, Line 46, Claim 12:
"liner" should be --linear--

Column 16, Line 4, Claim 13:
"peal" should be --pedal--

Column 16, Line 37, Claim 19:
"peal" should be --pedal--

Signed and Sealed this

Second Day of September, 2008

JON W. DUDAS
*Director of the United States Patent and Trademark Office*